United States Patent [19]

Szymaszek et al.

[11] 4,275,570

[45] Jun. 30, 1981

[54] OIL COOLING MEANS FOR REFRIGERATION SCREW COMPRESSOR

[75] Inventors: Paul G. Szymaszek; Robert A. Hall, both of Milwaukee, Wis.

[73] Assignee: Vilter Manufacturing Corporation, Milwaukee, Wis.

[21] Appl. No.: 159,502

[22] Filed: Jun. 16, 1980

[51] Int. Cl.[3] ..... F25B 43/02

[52] U.S. Cl. ..... 62/468; 62/470

[58] Field of Search ..... 62/468, 470, 473, 84, 62/505

[56] References Cited

U.S. PATENT DOCUMENTS

| | | | |
|---|---|---|---|
| 3,710,590 | 1/1973 | Kocher | 62/84 |
| 3,721,108 | 3/1973 | Kocher | 62/505 |
| 3,795,117 | 3/1974 | Moody, Jr. et al. | 62/505 |
| 3,811,291 | 5/1974 | Schibbye | 62/473 |
| 3,848,422 | 11/1974 | Schibbye | 62/505 |
| 3,874,192 | 4/1975 | Kato | 62/84 |
| 4,180,986 | 1/1980 | Shaw | 62/473 |

*Primary Examiner*—Ronald C. Capossela
*Attorney, Agent, or Firm*—James E. Nilles

[57] ABSTRACT

In a large refrigeration system comprising a screw compressor of controllably variable output, compressor lubricating oil, discharged from the compressor in a mixture with compressed refrigerant, is separated from the refrigerant at an oil separator from which it is returned to the compressor. Compressed refrigerant flows from the separator, through a condenser, to a high pressure receiver, where it is held for circulation through an evaporator and thence back to the compressor.

Through a bypass conduit in which a small liquid refrigerant pump is connected, condensed refrigerant from the receiver is delivered to a duct communicating the compressor discharge outlet with the oil separator inlet, to cool the oil-refrigerant mixture before it enters the separator. A thermostat senses temperature of that mixture near the separator inlet and so controls a throttling valve in the bypass conduit as to maintain that temperature substantially constant.

5 Claims, 1 Drawing Figure

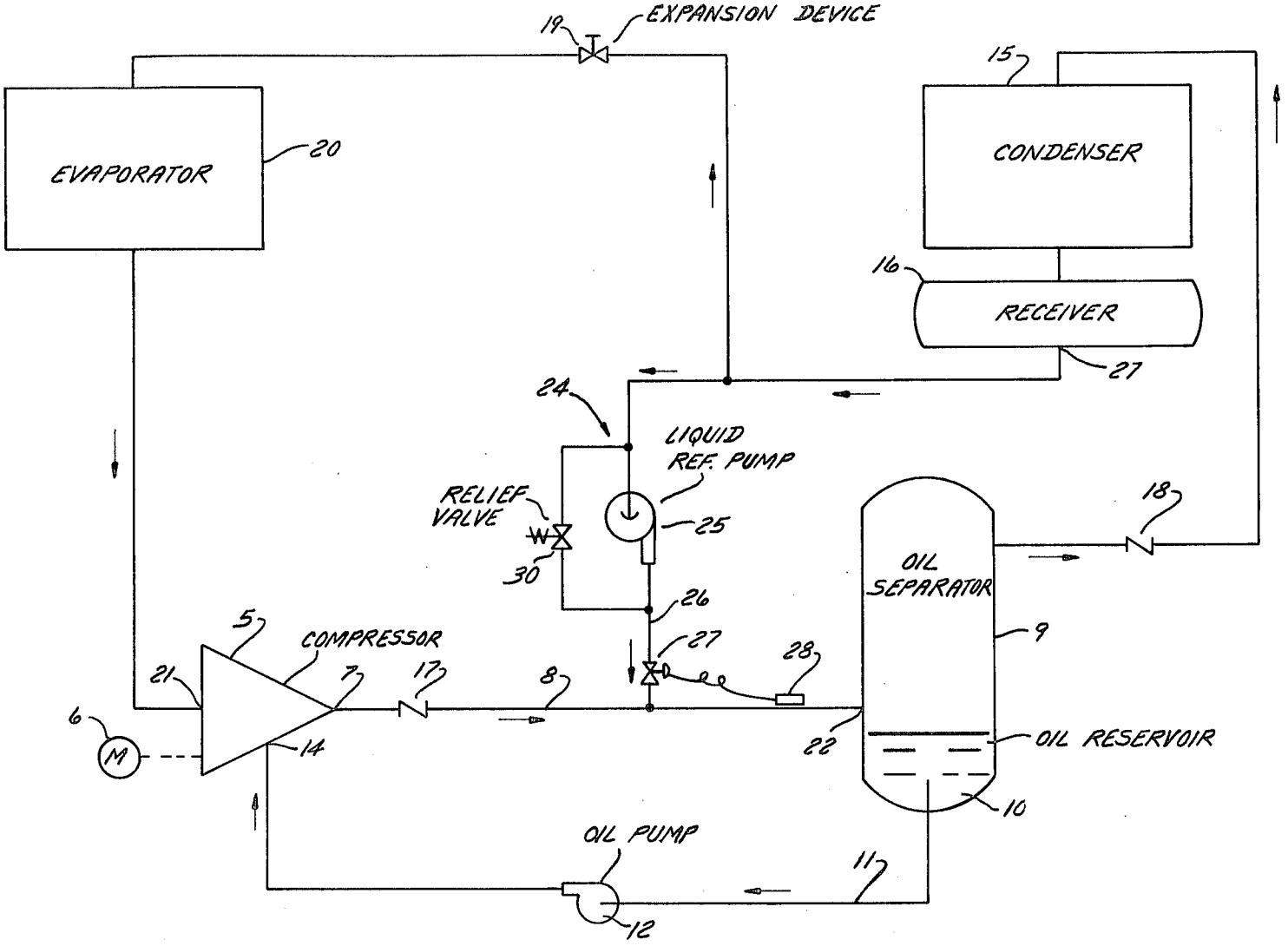
CONDENSER
RECEIVER
OIL SEPARATOR
OIL RESERVOIR
EXPANSION DEVICE
LIQUID REF. PUMP
RELIEF VALVE
OIL PUMP
COMPRESSOR
EVAPORATOR
M
5
6
7
8
9
10
11
12
14
15
16
17
18
19
20
21
22
24
25
26
27
28
30

OIL COOLING MEANS FOR REFRIGERATION SCREW COMPRESSOR

FIELD OF THE INVENTION

This invention relates to refrigeration systems wherein refrigerant is compressed by a screw compressor of controllably variable capacity that is lubricated and cooled by the circulation of oil therethrough and wherein a mixture of oil and compressed refrigerant that issues from a discharge outlet of the compressor is passed through an oil separator from which the oil is circulated back to the compressor, and the invention is more particularly concerned with improved means in such a system for cooling the oil discharged from the compressor before it is circulated back thereto.

BACKGROUND OF THE INVENTION

In many prior refrigeration systems that employ a variable capacity screw compressor, the oil that seals, cools and lubricates the compressor, after being separated from compressed refrigerant at an oil separator into which the compressor discharges, is passed through an oil cooler in the course of being returned to the compressor from the oil separator. The oil cooler is usually a heat exchanger through which the oil flows in indirect heat exchange relation to a cooling medium. When the oil cooling medium is air, the oil cooler must include a fan or blower for producing a substantial rate of air flow across the heat exchanger surfaces. A water-cooled oil cooler requires a source of cool water or a cooling tower or the like, and usually also a pump and associated plumbing for circulating the water through the oil cooler. In all such installations a substantial first cost is involved in providing the oil cooling heat exchanger, its plumbing, and the fan, blower or pump needed for circulating the cooling medium; and there is a continuing and rather substantial operating cost for the power needed for circulation of the cooling medium.

In the refrigeration system disclosed in U.S. Pat. No. 3,710,590, to E. J. Kocher, compressor oil, after being separated from compressed refrigerant, was cooled by indirect heat exchange with liquid refrigerant drawn from a high pressure receiver. By means of a refrigerant pump, the withdrawn refrigerant was circulated through an oil cooler, thence through a desuperheating coil in the oil separator, and was finally discharged to the inlet side of the condenser to be cooled back down to saturation temperature and returned to the receiver. A principal advantage of this arrangement was that it avoided fouling of the oil cooling heat exchanger such as could occur when the cooling medium was air or water that might contain dirt. However, the system needed a heat exchanger unit for oil cooling as well as a pump for circulating the refrigerant therethrough.

In the refrigeration system disclosed in U.S. Pat. No. 3,795,117, to Moody et al, liquid refrigerant was fed directly into the screw compressor, intermediate its suction and discharge ends, to cool the compressor and the captive oil therein. This eliminated the need for an oil cooling heat exchanger, since the oil was cooled by direct heat exchange at the compressor, and it also eliminated the need for a pump because the refrigerant diverted to oil cooling flowed to the compressor under the difference in pressure between the high pressure side of the system and the compressor stage at which the diverted refrigerant was injected.

Other arrangements have also been proposed wherein refrigerant used for compressor oil cooling, drawn from the high pressure side of the system, was returned to the screw compressor at a low pressure or intermediate pressure stage thereof, to eliminate the need for a pump for circulation of the oil cooling medium.

In fact, however, such prior systems were not particularly economical in operation, and with increasing energy costs their operating inefficiencies have become more significant. When the refrigerant used for oil cooling is allowed to undergo a decrease in pressure for oil cooling purposes, then some portion of the compressor input power is being devoted to oil cooling. The power rating of the compressor must therefore be correspondingly higher than would be needed if all of its input power were being applied to the refrigeration task for which it is intended. The excess compressor power rating required for oil cooling represents a capital cost which at least partially offsets the capital saving achieved by eliminating an oil cooling heat exchanger and a pump for oil cooling medium. More important, it has been found that compression of the refrigerant used for oil cooling consumes from 3% to 12% of the full load power delivered by the compressor motor. Taking the cost of energy at the currently estimated $200 per horsepower per year, this means that in a system with a 200 horsepower compressor, the energy cost for oil cooling alone will be between $1,200 and $4,800 per year.

The present invention contemplates a screw compressor refrigeration system wherein liquid refrigerant is employed for cooling the oil that lubricates and seals the screw compressor but wherein the refrigerant so employed is both drawn from and delivered back to the system at its high-pressure side and therefore does not pass through the compressor.

The most nearly pertinent prior art with respect to this arrangement is U.S. Pat. No. 3,874,192, to E. Kato. In the system disclosed in that patent, liquid refrigerant drawn from the high pressure receptacle is delivered to the mixture of oil and compressed refrigerant flowing from the compressor to the oil separator. Such delivery takes place through an atomizer in the duct that communicates the discharge outlet of the compressor with the inlet to the oil separator. To ensure flow of liquid refrigerant through the atomizer, as the patent points out, the liquid refrigerant source must be at a higher elevation than the atomizer port, or else the atomizer outlet must comprise an ejector that utilizes suction effect due to flow of compressed refrigerant through the duct in which the atomizer is installed.

It is evident that the apparatus disclosed by the Kato patent is intended for a refrigeration system small enough to pose no problem in providing for the necessary height relationship between the liquid refrigerant source and the atomizer outlet. The Kato apparatus may be operative when that refrigerant source is at or only slightly below the level of the atomizer outlet, but it obviously could not function satisfactorily with the atomizer port at a substantially higher level than the liquid refrigerant source.

A more important objection to the Kato apparatus, and one that is not apparent from the patent disclosure, is that it is not satisfactorily operative with a variable capacity screw compressor such as would be used in a large refrigeration unit. In the conduit that carries liquid refrigerant to the atomizer outlet Kato has an electromagnetically actuated valve that is open when the compressor motor is running and closed when that motor is stopped. The output of a variable capacity screw compressor can be controllably varied from the full 100% of its capacity all the way down to as little as 10% thereof. At low compressor outputs, and with merely on-off control of the flow of liquid refrigerant for oil cooling, there would be excessive delivery of such refrigerant if the high pressure receptacle were at a higher elevation than the atomizer outlet and no delivery of it if the high pressure receptacle were substantially below the atomizer outlet. With no delivery of liquid refrigerant, there would of course be no oil cooling, with obviously undesirable consequences. Delivery of liquid refrigerant at too high a rate relative to the rate of discharge of compressed refrigerant from the compressor would have an equally detrimental effect because the compressor refrigerant would be cooled to saturation temperature, and drops of liquid refrigerant would form in the stream of mixed oil and refrigerant entering the oil separator. The liquid refrigerant would be separated out of the compressed refrigerant vapor along with the oil, and such liquid refrigerant would cause cavitation at the pump that circulates oil back to the compressor from the oil separator, so that the compressor would be starved for oil in consequence of loss of oil pressure at that pump.

SUMMARY OF THE INVENTION

The general object of the present invention is to provide oil cooling means for a refrigeration system that comprises a variable capacity screw compressor, said oil cooling means being so arranged that liquid refrigerant withdrawn from a high pressure receptacle in the system is delivered to the mixture of oil and compressed refrigerant flowing from the discharge outlet of the compressor to the inlet of an oil separator, for direct heat exchange with the oil in said mixture, and being further so arranged that the delivery of liquid refrigerant to said mixture is always metered in correspondence with the percentage of its full capacity at which the compressor is operating.

It is also a general object of this invention to provide a refrigeration system comprising a variable capacity screw compressor and having oil cooling means that consumes substantially less energy than has been needed for oil cooling in comparable prior systems and whereby the entire employed power input to the compressor is allowed to be devoted to the assigned refrigeration task, no part of that power input being needed for oil cooling.

Another general object of this invention is to provide highly efficient oil cooling means for a refrigeration system comprising a variable capacity screw compressor, which oil cooling means has a low first cost because it does not require the presence of an oil cooling heat exchanger in the system, does not require the compressor to have any higher rated power input than is needed for the assigned refrigeration task, and comprises relatively simple and inexpensive apparatus.

Another and more specific object of this invention is to provide energy-efficient oil cooling means that can be readily installed in an existing refrigeration system comprising a variable capacity screw compressor and having a prior type of oil cooling arrangement, and wherewith such retrofitting can be accomplished at relatively low cost for new equipment and with a minimum of modification on the existing system.

Another specific object of the invention is to provide oil cooling means for a refrigeration system comprising a variable capacity screw compressor, wherein liquid refrigerant is employed for oil cooling by direct heat exchange with the oil and also serves for desuperheating compressed refrigerant and for improving the efficancy of the oil separator.

In general, these and other objects of the present invention are achieved in a refrigeration system comprising a screw compressor of controllably variable capacity which is cooled and lubricated by the circulation of oil therethrough and which has a discharge outlet from which a mixture of oil and compressed refrigerant issues, an oil separator communicated with said discharge outlet through a duct, means for circulating the oil back to the screw compressor from the oil separator, and a receiver or high pressure receptacle to which refrigerant flows from the oil separator through a condenser and in which liquid refrigerant is held for circulation through an evaporator and thence back to the screw compressor. The invention provides oil cooling means for such a system, and is characterized by a liquid refrigerant pump; delivery means connecting said pump in an oil cooling bypass having an inlet at said receiver and an outlet at said duct, whereby the pump can deliver to said mixture, as it flows to the oil separator, a flow of liquid refrigerant that cools said mixture; sensor means for detecting a function of the percentage of its full capacity at which the screw compressor is operating and for producing an output which substantially corresponds to said detected function; and said delivery means having a flow metering means connected with said sensor means to receive said output therefrom and whereby the rate of flow of liquid refrigerant to said duct is controlled in substantial correspondence with the rate of discharge of said mixture from the screw compressor.

BRIEF DESCRIPTION OF DRAWING

The accompanying drawing, which depicts what is now regarded as a preferred embodiment of the invention, is a diagrammatic representation of a refrigeration system embodying the principles of the invention.

DETAILED DESCRIPTION OF PREFERRED EMBODIMENT OF THE INVENTION

In the accompanying drawing, the numeral 5 designates a screw compressor for a high capacity refrigeration system such as is employed, for example, for air conditioning an office building. The screw compressor 5 is driven by a motor 6 that may be rated at several hundred horsepower. As is conventional, the screw compressor 5 can be selectively operated at its full capacity or at any desired percentage of its full capacity, down to as low as 10%. Means are known for controllably varying the output of the compressor in accordance with cooling load requirements, and therefore such capacity control means is not shown.

As is also conventional, a substantial amount of oil must pass through the screw compressor 5 at all times that it is in operation. The oil lubricates the bearings and other moving parts of the compressor 5, transmits torque from a driving rotor to a driven rotor of the compressor, and provides screw-to-screw and screw-to-casing seals that prevent the escape of pressurized refrigerant from the compressor. Another and very important function of the oil is to cool the compressor, which becomes heated in consequence of the work that it performs in compressing refrigerant; and in order to perform this cooling function the oil must circulate through the compressor and must itself be cooled outside the compressor.

Oil is discharged from the screw compressor 5 in a mixture with compressed refrigerant. That mixture, which issues from the screw compressor at its discharge outlet 7, is conducted by means of a discharge duct 8 to an oil separator 9 at which the oil is separated from the compressed refrigerant and settles into a sump or oil reservoir 10 that is at the bottom of the oil separator. From the oil reservoir 10 the oil is circulated back to the compressor 5 by means of an oil return duct 11 wherein an oil pump 12 is connected and which has its inlet at the oil reservoir 10 and leads to the oil inlet 14 of the compressor.

As is conventional, the compressed refrigerant from which the oil has been separated is conducted from the oil separator 9 to a condenser 15 at which it is cooled to its saturation temperature to be condensed to a liquid; and from the condenser 15 the liquid refrigerant is discharged into a high pressure receiver 16, where it is held for release to the low pressure side of the system, at which refrigeration takes place.

To prevent reverse flow of refrigerant when the compressor 5 is shut down or is operated at reduced output, there is a check valve 17 in the discharge duct 8 and another check valve 18 between the oil separator 9 and the condenser 15.

Most of the liquid refrigerant is conducted from the receiver 16 through an expansion device 19 to an evaporator 20 in which the refrigerant takes up heat and vaporizes. The warm vapor-phase refrigerant, which is at a comparatively low pressure, is conducted from the evaporator 20 to the inlet 21 of the screw compressor 5, to be compressed for a repetition of the cycle.

The refrigeration system of the present invention comprises delivery means 24 by which a relatively small portion of the liquid refrigerant available at the high pressure receiver 16 is withdrawn therefrom and is delivered to the discharge duct 8 in which oil mixed with compressed refrigerant flows to the inlet 22 of the oil separator 9. Because the heat energy of such diverted liquid refrigerant is substantially lower than that of the mixture of oil and compressed refrigerant in said duct 8, the diverted refrigerant cools that mixture, picking up heat therefrom while passing from the liquid to the vapor phase without undergoing substantial change in pressure. The compressed refrigerant component of the mixture issuing from the compressor 5 is thus desuperheated, with the result that no more heat has to be rejected at the condenser 15 than would be the case with a prior refrigeration system in which condensed refrigerant was injected into the screw compressor, and the condenser 15 can be of corresponding size.

With proper metering of the flow of liquid refrigerant delivered to the discharge duct 8, as explained hereinafter, the temperature of the mixture entering the oil separator 9 can be brought down to substantially the value desired for oil that is to be recirculated back to the oil inlet 14 of the compressor 5. Such reduction of the temperature of the oil component of the mixture entering the oil separator 9 has the effect of improving the efficacy of the oil separator, because any vaporized oil in the mixture tends to be condensed into droplets which are readily separated from the gaseous refrigerant.

It will be apparent that the liquid refrigerant that is diverted from the receiver 16 to the discharge duct 8 is bypassed across the low pressure side of the system that comprises the evaporator 20 and the compressor 5.

To move liquid refrigerant from the receiver 16 to the duct 8, the delivery means 24 comprises a liquid refrigerant pump 25, connected in a bypass conduit 26 that has its inlet 27 at the receiver 16 and its outlet at said duct 8. The pump 25 is not required to force the liquid refrigerant against any substantially adverse pressure gradient, and therefore it can be relatively small, so as to be low in first cost as well as inexpensive to operate. Typically, for a refrigeration system comprising a screw compressor requiring a 700 horsepower drive motor, the pump 25 can be driven by a 2 to 3 horsepower motor. By contrast, if refrigerant used for oil cooling were returned to the compressor, and assuming the minimum 3% horsepower penalty for compression of such refrigerant, 21 horsepower would be devoted to oil cooling.

Because the bypassed liquid refrigerant is maintained at substantially high pressure as it passes through the refrigerant pump 25, that pump must have adequate seals; but the higher cost of a pump equipped with high pressure seals is insignificant in relation to the economic benefits achieved with the oil cooling means of the present invention.

As pointed out above, the rate of delivery of liquid refrigerant to the discharge duct 8 should be substantially matched to the prevailing output of the screw compressor 5. To that end, the delivery means 24 comprises controllable flow metering means 27, here illustrated as an adjustable throttling valve, and a sensor 28 for producing an output corresponding to a function of the percentage of its full rated capacity at which the compressor 5 is operating. The output of the sensor 28 is impressed upon the flow metering means 27 to adjust the latter in accordance with the prevailing value of that sensor output. In the present case, and as is preferred, the sensor 28 is a thermostat in the discharge duct 8, at a location between the communication of that duct with the delivery means 24 and the inlet 22 to the oil separator. The thermostat 28 so adjusts the throttling valve 27 as to maintain a substantially constant temperature of the mixture of oil and refrigerant flowing into the oil separator 9.

Instead of being controlled by a thermostat, the throttling valve 27 could be adjusted in correspondence with the position of the slide valve or other control means that provides for adjustment of the percentage of its full capacity at which the compressor 5 is operating. However, thermostatic control is preferred because such control not only takes account of the prevailing compressor output but also takes into account certain factors (e.g., ambient temperatures) which have a secondary influence on the rate of flow through the throttling valve that is needed for optimum oil cooling.

Where the flow metering means 27 is a throttling valve, as here shown, it is connected in the bypass conduit 26 at a location downstream from the refrigerant pump 25. If the pump 25 is a positive displacement pump, a pressure relief valve 30 is connected in a return circuit between its outlet and its inlet, so that such of its output as is in excess of what is passed by the throttling valve 27 is circulated back to its inlet. The pressure relief valve 30 would not be needed if the refrigeration pump 25 were a centrifugal pump or the like.

It has been found that there is no particular need for atomization of the liquid refrigerant introduced into the discharge duct 8, but on the other hand it is important to ensure intimate mixing of that refrigerant with the mixture flowing in that duct. For effecting such mixing, the portion of the duct 8 that is downstream from the outlet of the bypass conduit 26 can have screens or the like therein, whereby a turbulent flow is induced. Pads of screening, somewhat like steel wool pads, have been found suitable. Although there is some tendency for oil to settle on such pads, the flow velocity through the duct 8 is high enough to prevent any substantial accumulation on them.

From the foregoing description taken with the accompanying drawing it will be apparent that this invention provides simple, inexpensive and very energy efficient means for cooling the compressor lubricating oil in a large refrigeration system comprising a screw compressor, and it will also be apparent that the invention offers important secondary advantages in affording desuperheating of compressed refrigerant and greater efficacy of the oil separator.

What is claimed as the invention is:

1. In a refrigeration system of the type comprising a screw compressor of controllably variable capacity which is cooled and lubricated by the circulation of oil therethrough and which has a discharge outlet from which a mixture of compressed refrigerant and oil issues, an oil separator communicated with said discharge outlet through a discharge duct, means for circulating oil back to the screw compressor from the oil separator and a receiver to which refrigerant flows from the oil separator through a condenser and in which liquid refrigerant is held for circulation through an evaporator and thence back to the screw compressor, oil cooling means for cooling the oil discharged from the compressor before it is circulated back thereto, said oil cooling means being characterized by:

A. a liquid refrigerant pump;

B. delivery means connecting said pump in an oil cooling bypass having an inlet at said receiver and an outlet at said discharge duct, whereby the pump can deliver to said mixture, as it flows to the oil separator, a flow of liquid refrigerant that cools said mixture;

C. sensor means for detecting a function of the percentage of its full capacity at which the screw compressor is operating and for producing an output which substantially corresponds to said detected function; and D. said delivery means having flow metering means connected with said sensor means to receive said output therefrom and whereby the rate of flow of liquid refrigerant to said discharge duct is controlled in substantial correspondence with the rate of discharge of said mixture from the screw compressor.

2. The refrigeration system of claim 1 wherein said liquid refrigerant pump is a substantially constant volume pump having an inlet and an outlet, further characterized by said flow metering means comprising:

(1) a controllable throttling valve connected with said sensor means to receive said output therefrom and connected between said pump and the discharge duct to restrict flow of liquid refrigerant to the discharge duct in accordance with the output of said sensor means; and (2) a pressure relief valve connected between the outlet and the inlet of the pump to feed back around the pump liquid refrigerant in excess of that passed to the discharge duct by the throttling valve.

3. A refrigeration system of the type comprising a screw compressor of controllably variable capacity which is cooled and lubricated by the circulation of oil therethrough and which has a discharge outlet from which compressed refrigerant issues mixed with oil, an oil separator, duct means communicating said discharge outlet with the oil separator, means for circulating oil back to the screw compressor from the oil separator, a condensor through which compressed refrigerant flows from the oil separator, and a receiver into which the condenser discharges and wherein condensed refrigerant is held for circulation through an evaporator and thence back to the screw compressor, said refrigeration system being characterized by oil cooling means comprising:

A. a liquid refrigerant pump;

B. delivery means cooperating with said pump and having (1) an inlet communicated with the receiver and (2) an outlet communicated with said duct means, for delivering a flow of condensed refrigerant from the receiver into the mixture of oil and compressed refrigerant flowing to the oil separator in said duct means;

C. flow metering means operatively associated with said delivery means and said pump for controllably varying the rate of flow of condensed refrigerant from the receiver into said duct means; and D. control means responsive to a function of the percentage of its full capacity at which the screw compressor is operating and operatively associated with said flow metering means to maintain a substantially constant temperature in said duct means at its communication with the oil separator.

4. The refrigeration system of claim 3 wherein said control means comprises temperature sensing means located in said duct means, between the outlet of the delivery means and the communication of said duct means with the oil separator.

5. In a refrigeration system that comprises a screw compressor of controllably variable capacity which is cooled and lubricated by the circulation of oil therethrough and which has a discharge outlet from which a mixture of compressed refrigerant and oil issues, an oil separator having an inlet, a duct in which said mixture flows from said discharge outlet to said inlet means for circulating oil back to the screw compressor from the oil separator, and a receiver to which refrigerant flows from the oil separator through a condenser and wherein liquid refrigerant is held for circulation through an evaporator and thence back to the screw compressor, oil cooling means for cooling the oil discharged from the compressor before it is circulated back thereto, said cooling means being characterized by:

A. a liquid refrigerant pump;

B. means defining a liquid refrigerant bypass in which said pump is connected and by which liquid refrigerant drawn from the receiver is delivered to said duct at a location between said discharge outlet and said inlet;

C. means in said duct for mixing the liquid refrigerant delivered thereto with said mixture flowing therein;

D. a temperature sensor in said duct, between said location and the oil separator inlet; and E. metering means in said liquid refrigerant bypass, connected with said temperature sensor and responsive to the temperature sensed by it, for so controlling delivery of liquid refrigerant to said duct as to maintain a substantially constant temperature of mixture entering the oil separator.

* * * * *